United States Patent [19]

Feldman et al.

[11] 3,998,639

[45] Dec. 21, 1976

[54] METHODS FOR DETERMINING FEATURE-SIZE ACCURACY OF CIRCUIT PATTERNS

[75] Inventors: Martin Feldman, Murray Hill; Donald Lawrence White, Bernardsville, both of N.J.

[73] Assignee: Bell Telephone Laboratories, Incorporated, Murray Hill, N.J.

[22] Filed: Nov. 19, 1974

[21] Appl. No.: 525,210

[52] U.S. Cl. ..... 96/36.2; 96/27 R

[51] Int. Cl.[2] ..... G03C 5/00

[58] Field of Search ..... 96/27 R, 36.2, 33, 46; 29/407, 593

[56] References Cited

UNITED STATES PATENTS

| | | | |
|---|---|---|---|
| 3,393,618 | 7/1968 | Baker | 96/33 |
| 3,506,442 | 4/1970 | Kerwin | 96/36.2 |
| 3,555,172 | 1/1971 | Heinz | 96/36.2 |
| 3,607,267 | 9/1971 | Garrels | 96/27 R |
| 3,690,881 | 9/1972 | King | 96/27 R |
| 3,719,487 | 3/1973 | Schutze et al. | 96/27 R |
| 3,746,540 | 7/1973 | Rarey | 96/36.4 |

*Primary Examiner*—Edward C. Kimlin
*Attorney, Agent, or Firm*—R. B. Anderson; Lucian C. Canepa

[57] ABSTRACT

In IC fabrication, feature size accuracy is monitored by making a test pattern composed of grating lines in proximity to two reference patterns. With the proper feature size, the test pattern will visually appear to have a shade of grey intermediate that of the two reference patterns. Too small a feature size will make the test pattern lighter, while too large a feature size will make it appear darker.

13 Claims, 4 Drawing Figures

METHODS FOR DETERMINING FEATURE-SIZE ACCURACY OF CIRCUIT PATTERNS

BACKGROUND OF THE INVENTION

This invention relates to printing processes, and more particularly, to methods for determining feature-size accuracy in photolithographic printing.

Photolithographic printing is widely used in the electronics industry for defining electronic circuit patterns on semiconductor wafer surfaces. A large scale version of the pattern is typically made which is photographically reduced in size to form the mask used in printing the circuit pattern. The pattern is defined by transparent regions on the mask through which light is projected for exposure of a photoresist film on the wafer surface.

As electronic circuit patterns have become more complex, it has become important to monitor the accuracy with which the patterns are printed, particularly in the production of masks. Overexposure during photolithographic printing, for example, may result in feature sizes slightly larger than intended. Since accuracy requirements are typically less than one micron, it is important to develop techniques for determining any such deviations.

Because the desired circuit patterns are defined by opaque and transparent areas, devices such as the scanning densitometer, which record light transmission as a function of distance, may be used for monitoring feature size accuracy. This of course requires sophisticated equipment and is cumbersome and time-consuming to use.

SUMMARY OF THE INVENTION

It is an object of this invention to simplify the determination of feature size accuracy in printing processes.

We have found that if a grid of lines is printed having linewidths that are sufficiently small, the grid can be observed visually as a single grey area and that, if minute deviations from the feature size accuracy occur, these deviations are manifested by visually observable deviations in the shade of grey of the pattern. For example, it would ordinarily be impossible to determine without the aid of a microscope or other sophisticated apparatus whether a printed feature deviated from its desired size by ± ½ micron. However, if a grey pattern consisting of 5 micron wide lines and spaces is formed it will be observed as a grey area, the shade of which changes significantly if the width of the lines is reduced by as much as ½ micron. Thus, to determine feature size deviations of less than a micron without the aid of a microscope, one can print a grid of 5 micron lines and spaces, compare it with a reference shade of grey, and estimate the deviation, if any, from the desired linewidth as actually printed.

By having a plurality of reference patterns, one can estimate the deviation with fair precision. For example, if the printed shade of grey matches a medium pattern, that may indicate a zero feature size deviation; matching a dark pattern may designate a deviation of +0.5 microns; and if it matches a light pattern, that may be taken as a −0.5 micron deviation.

For most purposes we have found that it is more convenient to print the reference patterns along with the test pattern. The relative accuracy of the reference patterns can be insured by making them with lines and spaces sufficiently wide as not to be affected by the minute feature-size deviations to be detected. Thus, two reference patterns composed of thick lines and spaces, one representing a grey of maximum darkness, and the other one of maximum lightness, may be printed so as to be surrounded by the fine-line test pattern used to determine deviation. As before, if the test pattern is darker than the dark reference pattern, or lighter than the light reference pattern, it may be inferred that the feature size deviation is too large and that the printing is unsatisfactory. By printing the reference patterns in direct proximity to the test pattern, one insures ease of visual comparison. While we have emphasized the avoidance of complex tools for determining microscopic feature size deviations, it may be preferred that the operator use a magnifying glass or some other such instrument since the patterns themselves are typically fairly small.

The invention is easy to use in determining feature-size deviations in the formation of masks because the mask is by its nature composed of transparent and opaque regions and different shades of grey can be determined by observing diffused light through the mask. Sometimes it is more difficult to use the invention in connection with printed patterns on a wafer, because silicon wafers are normally opaque. However, since silicon wafers are transparent to infrared light, such light can be directed through the wafer and observed with an appropriate instrument. Alternatively, the wafer may be coated with a fluorescent material which emits light after the printing has taken place and makes the patterns easy to recognize.

These and other objects, features and advantages of the invention will be better understood from the following detailed description taken in conjunction with the accompanying drawings.

DRAWING DESCRIPTION

DETAILED DESCRIPTION

Figure 1:
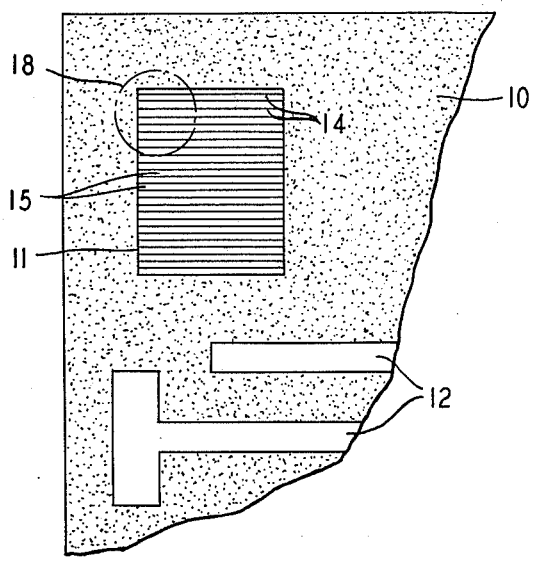
FIG. 1 is a view of a portion of a mask made in accordance with an illustrative embodiment of the invention.

Referring now to FIG. 1 there is shown a portion of a photolithographic mask 10 containing a test pattern 11. A major portion of the mask 10 comprises a part of an electronic circuit pattern, shown schematically as 12, which is eventually used for exposing the semiconductor wafer photoresist film. As is known, such exposures are used for describing areas of impurity diffusion, metalization, and the like, and the accuracy with which such patterns may be formed critically determines the quality of the integrated circuit that can be made. The mask 10 is itself made by photolithographic masking and etching from a master mask, and may typically be made from a chrome film, held on a glass substrate, the film being selectively etched to form opaque and transparent regions defining the pattern. Mask 10 is typically used by putting it in contact with the photoresist-covered surface of the semiconductor wafer with light being projected through the transparent regions to expose selectively the photoresist.

In determining whether mask 10 has been made with sufficient accuracy, it is usually necessary to determine whether the features formed are of their proper predetermined size. Since accuracy requirements are typically less than ½ micron, it is normally necessary to inspect the features with a microscope or other sensitive instrument.

Figure 1A:
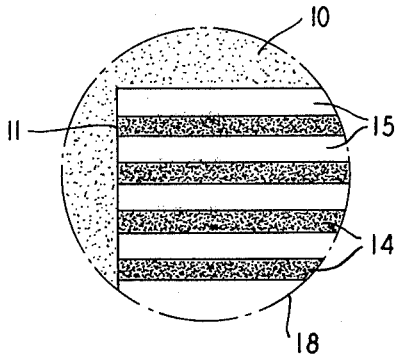
FIG. 1A is an enlarged view of part of FIG. 1.

In accordance with the invention, feature size accuracy is determined from the test pattern 11 which is comprised of horizontal lines and spaces 14 and 15 which are respectively opaque and transparent. The structure of the test pattern can be appreciated from FIG. 1A, which is an enlargement of portion 18. One way of quickly determining whether the test pattern features are of their proper size would be to scan the pattern with a scanning densitometer, a device which automatically records light transmission as a function of distance. Thus, the widths of the opaque and transparent regions could be measured from a graphical output of the device.

However, in accordance with the invention, the use of such instruments is obviated by making visual estimates based on the shade of grey of the test pattern. If the lines and spaces 14 and 15 are each as little as 5 microns wide, the individual lines are not perceptible, because they cannot be separately resolved by the eye, but the entire pattern will have a recognizable shade of grey. If, for example, due to underexposure during the photolithographic process, the lines 14 are only 4.5 microns wide, and the spaces 15 are 5.5 microns wide, the ratio of opaque to transparent area will have changed by 10 percent and the shade of grey of the pattern will be perceptibly lighter. One can appreciate that feature size changes of even less than 0.5 microns can be readily perceived with fair accuracy by making use of this phenomenon.

Figure 2:
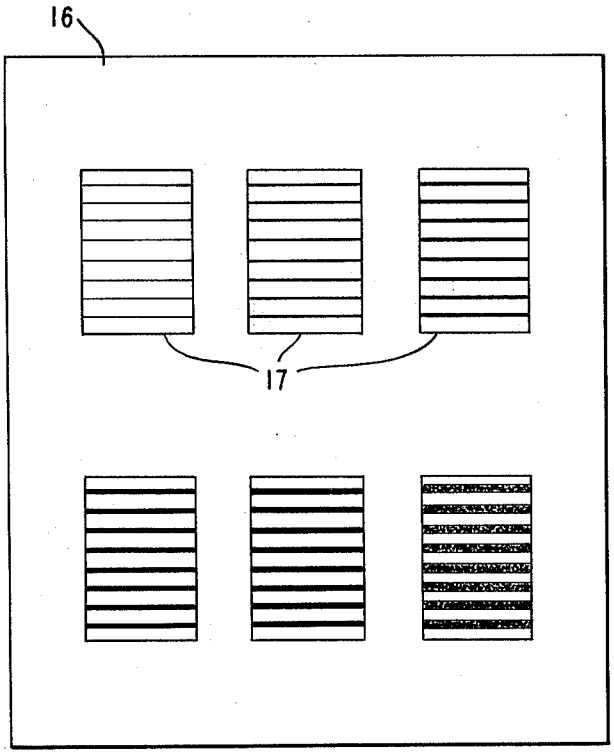
FIG. 2 illustrates an array of reference patterns used in accordance with one embodiment of the invention.

FIG. 2 shows a reference plate 16 comprising a plurality of reference patterns 17 being of successively darker shades of grey. The shade of each pattern 17 may be equated with a specific line width or featuresize deviation. For example, one pattern may designate a zero feature-size deviation, the next darker pattern may designate a deviation of +0.25 microns, the next darker shade, +0.5 microns; the shade lighter may designate a deviation of −0.25 microns, and the succeeding lighter shade a deviation of −0.5 microns. If the test pattern 11 has a shade of grey that falls between two reference patterns, one may infer that the feature-size deviation is in that particular range; for example, the feature-size deviation may be between 0.25 and 0.5 microns and by merely comparing shades of grey, one may estimate with great accuracy that the deviation is +0.4 microns.

The reference patterns 17 preferably have the same structure as test pattern 11; namely, opaque lines separated by transparent spaces, although in principle any grey shade could be used as a reference. The test pattern 11 and reference patterns 17 should be viewed by looking through the patterns at light from a diffused source, as for example, light reflected from a white wall. If the light is not sufficiently diffused, the pattern will act as a grating to diffract the light and make comparisons more difficult. While we have emphasized the use of our techniques without optical instruments, in most practical instances it is preferable that the test pattern 11 is of as small an area on the mask 10 as possible, and therefore it may be preferable that the operator use an eyepiece or other magnifying glass in observing the grey shade of the pattern. Of course the drawings of the patterns are considerably distorted in that in actual practice the component lines and spaces would be much thinner.

Figure 3:
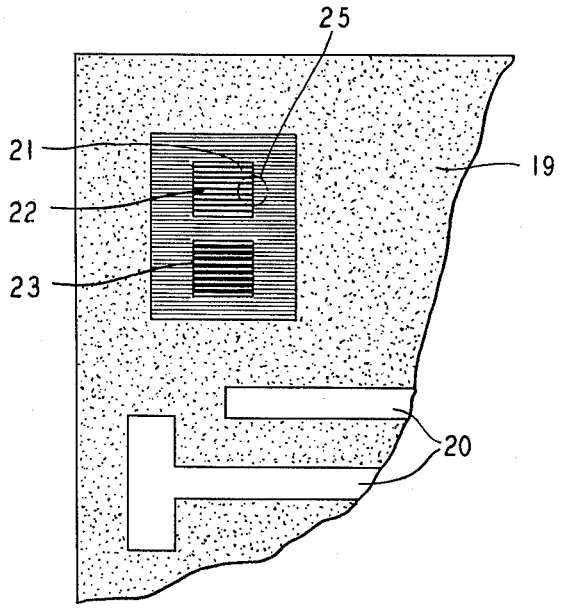
FIG. 3 is a view of a portion of a mask made in accordance with another embodiment of the invention.

Comparisons can be made more conveniently and accurately by printing the reference patterns on the mask in close proximity to the test pattern. Referring to FIG. 3, there is shown a mask 19 having a circuit pattern 20. A test pattern 21 surrounds two reference patterns 22 and 23. Reference pattern 23 is purposely made to be slightly darker than the optimum shade of grey and reference pattern 22 is made to be slightly lighter. These two reference grey shades are chosen such that the test pattern 21 is deemed to be satisfactory if it forms a shade of grey intermediate those of reference patterns 22 and 23. Since the reference patterns are surrounded by the test pattern, it is easy for the operator to determine whether the grey shade of the test pattern is between those of the reference patterns.

Figure 3A:
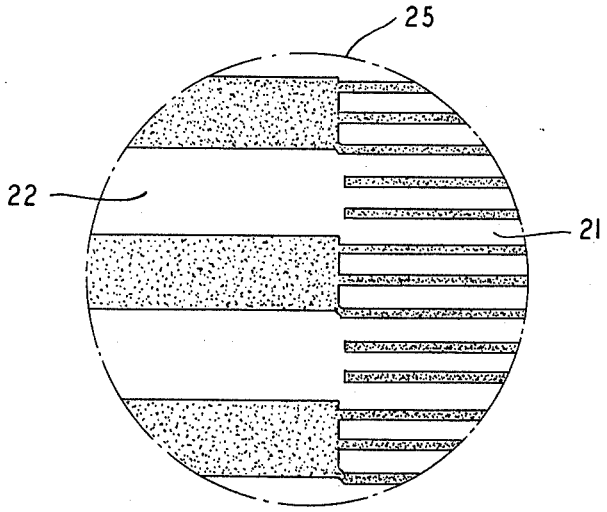
FIG. 3A is an enlarged view of part of FIG. 3.

The grey shades of the two reference patterns aee made to be relatively independent of feature size deviations by forming them of stripes that are wide with respect to any such deviation. For example, if the opaque lines of the reference patterns are made to be each on the order of 25 microns, they will be thin enough to form a shade of grey, and yet they will be so wide that deviations on the order of ½ micron will not substantially affect their grey shade. On the other hand, with the test pattern being defined by 5 micron lines, a deviation of ½ micron will change its light transmissivity by 10 percent, thus appreciably changing its shade of grey. The relative widths of the lines and spaces of the test pattern 21 and reference pattern 22 can be appreciated from FIG. 3A, which is an enlargement of portion 25 of FIG. 3.

In one embodiment that has been made for testing for deviations of ± ½ micron, the "dark" reference pattern 23 was made with 27 micron thick lines and 23 micron thick spaces. The "light" pattern 22 was made with 23 micron lines and 27 micron spaces and the test pattern 21 was made to have nominal 5 micron lines and 5 micron spaces. If the test pattern 21 is as dark as, or darker than, reference pattern 21, it may be inferred that the feature size deviation is more than + ½ micron and that the test pattern is formed of lines having thicknesses of at least 5.5 microns and spaces of 4.5 microns or less. If the test pattern is of a lighter shade of grey than reference pattern 22, it may be inferred that the test pattern has been printed to have opaque lines of 4.5 microns or less and transparent spaces of 5.5 microns or more, and that the feature-size deviation again exceeds one-half micron. Only if the shade of the test pattern is intermediate those of the reference patterns is the feature size deemed to be accurate within + 0.5 microns. In the embodiment made, the test pattern had dimensions of 1.0 millimeters by 1.3 millimeters and the reference patterns each had the dimension 0.5 millimeters by 0.5 millimeters.

In designing the reference patterns, the lines and spaces should be made sufficiently wide to be substantially unaffected by feature-size deviations, and yet sufficiently narrow so that they are not separately resolved when seen by the observer, but rather, form a grey shade. The shade of grey defined by the reference patterns is determined by the ratio of relatively opaque lines to the relatively transparent spaces. In determining precisely what ratios to use in forming the reference pattern, consider D to be the duty cycle of the pattern, which is defined as the ratio of line width to line width plus space width. For example, the duty cycle of reference pattern 23 is 27/50.

The fraction T of light S transmitted through the reference pattern is a function of the transmission coefficient $T_l$ of the opaque lines, the transmission coefficient $T_s$ of the transparent spaces and the duty cycle D, and can be shown to be given by $$T = DT_l + (1-D)T_s. \quad 1.$$

Consider the subscript R to represent the reference pattern and subscript T the test pattern. Then, the contrast ratio C of reference and test patterns is given by $$C = \frac{T_R}{T_T} = \frac{D_R T_l + (1 - D_R)T_s}{D_T T_l + (1 - D_T)T_s} \quad (2)$$

where $T_R$ is the fraction of light transmitted through the reference pattern and $T_T$ is the fraction of light transmitted through the test pattern. Emulsions and chrome masks have opaque lines and clear spaces such that $T_l = 0$ and $T_s = 1$. In this case the contrast ratio between two sections is given by $$C = (1 - D_R)/(1 - D_T) . \quad 3.$$

For iron oxide or GAF masks, the transmission coefficient of the lines $T_l$, to visible light, is about 0.3, which greatly reduces the contrast ratio. If the mask substrate is "Scotchclad," the transmission coefficient $T_s$ of the spaces is about 0.5, which also reduces the contrast ratio of iron oxide and GAF masks. With the foregoing information, one can easily design the reference patterns 22 and 23 so that, in the event of a maximum allowable deviation of line widths in one direction, the contrast ratio of reference pattern 22 with respect to the test pattern is one; that is, the test and reference patterns have identical duty cycles and greyness. With a maximum allowable deviation in the other direction, the contrast ratio of pattern 23 with respect to the test pattern, can likewise be designed to be one.

It is apparent that a number of different techniques could be combined with the invention to facilitate semiconductor photolithographic fabrication. For example, consider element 19 of FIG. 3 to be a silicon wafer rather than a mask, and consider the printed pattern to have been formed of photoresist in the usual manner. Since photoresist is colorless, the grey shades of the patterns cannot be seen by observing diffuse light reflected from the wafer. However, the photoresist may be made of fluorescent or other light-emitting material. In this case, particularly by viewing through an appropriate filter, the relative shade of the test pattern would vary with the feature-size accuracy in the same manner described before.

To observe metalized or other opaque patterns on a wafer, advantage may be taken of the relatively high transmissivity of silicon to infrared light. Infrared light may be directed through silicon, detected, and the resulting grey patterns observed as before. When the various patterns are being etched, infrared transmission through the silicon wafer may be monitored with a television camera, the pattern shade observed in real time, and the etching terminated at precisely the proper time to attain a desired feature size. That is, the feature-size accuracy of features etched in silicon may be controlled to within very high tolerances.

While it is most straightforward for the operator to determine grey level by visual comparison, such determination could be made automatically by devices such as a low-resolution scanning densitometer or a television camera. By measuring the integrated light intensity over the test area, such appropriately calibrated instruments could automatically indicate whether the grey level was within appropriate limits. Such instruments must be of low level to record area-wide intensity, rather than resolving individual lines and spaces.

The foregoing embodiments have been presented merely to illustrate the pertinent inventive concepts. Various other embodiments and modifications may be made by those skilled in the art without departing from the spirit and scope of the invention.

1. Method of determining size accuracy of circuit patterns formed on a substrate comprising the steps of:

forming circuit patterns on the substrate and simultaneously forming on the substrate a test pattern comprising a plurality of light regions and a plurality of dark regions, said regions being substantially sufficiently small such that said test pattern appears as having a substantially continuous grey shade;

forming at least one reference pattern on the substrate in close proximity to the test pattern, the reference pattern constituting a reference grey shade corresponding to a predetermined size accuracy; and comparing the grey shade of the test pattern to said reference grey shade thereby determining the size accuracy of the circuit patterns.

2. The method of claim 1 wherein:

the light and dark regions are defined by stripes printed on said substrate, the stripes being sufficiently thin that predictable feature-size deviations of the circuit patterns are significant with respect to the stripe thickness, whereby significant feature-size deviations are manifested by modifications of the grey shade of the test pattern.

3. The method of claim 2 wherein:

the stripes have a thickness of the order of 5 microns.

4. The method of claim 2 comprising the steps of:

printing first and second reference patterns on the substrate in proximity to the test pattern, the first reference pattern having a lighter grey shade than that of the second reference pattern;

and forming the test pattern to have a grey shade intermediate that of the first and second reference patterns in the absence of significant feature-size deviations.

5. The method of claim 4 wherein:

the reference patterns are formed of stripes that are sufficiently thin as not to be separately resolvable.

6. The method of claim 5 wherein:

the circuit patterns are formed on the substrate by a semiconductor integrated circuit photolithographic printing process;

the test pattern stripe thicknesses are of the order of 5 microns;

and the reference pattern stripe thicknesses are of the order of 25 microns.

7. The method of claim 5 wherein:

the first reference pattern comprises stripes having thicknesses of 23 microns separated by spaces of 27 microns;

and the second reference pattern comprises stripes of 27 microns separated by spaces of 23 microns.

8. In a photolithographic process for printing electronic circuit patterns on a substrate, a method of determining the feature-size accuracy of the printing process comprising the steps of:

forming a plurality of reference patterns having geometric configurations defined by relatively transparent and opaque areas, wherein the ratio of opaque areas to transparent areas varies slightly with each reference pattern, resulting in variations in shades of grey;

printing a test pattern on the substrate in close proximity to said reference patterns simultaneously with printing of the electronic circuit pattern;

and visually comparing said printed test pattern with at least one reference pattern to estimate the size accuracy of the printed electronic circuit pattern.

9. The process of claim 8 wherein:

each reference and test pattern comprises stripes of alternating transparent and opaque areas, the stripes being sufficiently closely spaced that the pattern appears as a single grey area.

10. The process of claim 9 wherein:

the reference patterns forming step comprises the step of printing first and second substantially identical reference patterns on the substrate, the second reference pattern having a higher ratio of opaque to transparent areas than that of the first reference pattern, whereby the second reference pattern appears as a darker shade of grey than the first reference pattern.

11. The process of claim 10 wherein:

the test pattern is printed on the substrate simultaneously with the printing of the first and second reference patterns, the constituent opaque and transparent stripes of the first and second reference patterns being several times wider than those of the test patterns, whereby variations of printed line width have a much more pronounced effect on the shade of grey of the test pattern than on the respective shades of grey of the first and second reference patterns.

12. The process of claim 11 wherein:

the constituent stripes of all of the patterns are substantially sufficiently thin as not to be separately resolvable by an observer;

the test pattern stripes are sufficiently thin that the ratio of opaque area to transparent area may be significantly affected by feature-size deviation occurring in the printing process;

and the stripes of the first and second reference patterns are sufficiently thick that the ratio of opaque area to transparent area is not significantly affected by feature-size deviation occurring in the printing process.

13. The process of claim 10 wherein:

the test pattern is printed on the substrate so as to substantially surround the first and second reference patterns.

* * * * *